US007255763B2

(12) United States Patent
Kobayashi et al.

(10) Patent No.: US 7,255,763 B2
(45) Date of Patent: Aug. 14, 2007

(54) PROCESS FOR MAKING FIBROUS WEB HAVING INELASTIC EXTENSIBILITY

(75) Inventors: Toshio Kobayashi, Kagawa ken (JP); Hiroki Goda, Kagawa-ken (JP); Kazunari Isogai, Kagawa-ken (JP); Satoshi Mitsuno, Kagawa-ken (JP)

(73) Assignee: Uni-Charm Corporation, Ehime-ken (JP)

( * ) Notice: Subject to any disclaimer, the term of this patent is extended or adjusted under 35 U.S.C. 154(b) by 578 days.

(21) Appl. No.: 10/269,798

(22) Filed: Oct. 14, 2002

(65) Prior Publication Data

US 2003/0090020 A1 May 15, 2003

(30) Foreign Application Priority Data

Oct. 15, 2001 (JP) ..... 2001-317356

(51) Int. Cl.
*B32B 37/00* (2006.01)

(52) U.S. Cl. ..... 156/167; 156/242.11

(58) Field of Classification Search ..... 156/160–167, 156/91, 252; 428/318.6, 364, 152, 361, 373, 428/304.1, 198, 297, 284–287, 392, 374; 442/361, 364, 381, 382, 392, 394
See application file for complete search history.

(56) References Cited

U.S. PATENT DOCUMENTS

| | | | | |
|---|---|---|---|---|
| 4,720,415 | A * | 1/1988 | Vander Wielen et al. | 428/152 |
| 4,770,656 | A * | 9/1988 | Proxmire et al. | 604/393 |
| 4,834,741 | A * | 5/1989 | Sabee | 604/385.29 |
| 4,855,179 | A * | 8/1989 | Bourland et al. | 442/409 |
| 4,863,779 | A * | 9/1989 | Daponte | 428/152 |
| 4,892,598 | A * | 1/1990 | Stevens et al. | 156/91 |
| 5,041,252 | A * | 8/1991 | Fujii et al. | 264/176.1 |
| 5,143,679 | A * | 9/1992 | Weber et al. | 264/288.8 |
| 5,342,335 | A * | 8/1994 | Rhim | 604/367 |
| 5,487,943 | A * | 1/1996 | Kozulla | 428/373 |
| 5,631,083 | A * | 5/1997 | Pinoca et al. | 428/365 |
| 5,763,333 | A * | 6/1998 | Suzuki et al. | 442/351 |
| 5,906,890 | A * | 5/1999 | Taniguchi et al. | 428/364 |
| 6,045,900 | A * | 4/2000 | Haffner et al. | 428/315.9 |
| 6,290,979 | B1 * | 9/2001 | Roe et al. | 424/402 |
| 6,469,130 | B1 * | 10/2002 | Qin et al. | 528/310 |
| 6,506,698 | B1 * | 1/2003 | Quantrille et al. | 442/361 |
| 2002/0001707 | A1 * | 1/2002 | Zhang et al. | 428/318.6 |

FOREIGN PATENT DOCUMENTS

| | | | |
|---|---|---|---|
| EP | 1 066 957 | A | 1/2001 |
| EP | 1 069 223 | A | 1/2001 |
| EP | 1126054 | A1 * | 8/2001 |
| JP | 2001-18315 | A | 1/2001 |
| WO | WO 9710300 | A1 * | 3/1997 |

* cited by examiner

*Primary Examiner*—Jeff H. Aftergut
(74) *Attorney, Agent, or Firm*—Butzel Long

(57) ABSTRACT

Component thermoplastic synthetic fiber having inelastic extensibility as well as fiber diameter of 5-20 μm constituting a fibrous web is obtained by melt spinning a mixture of two or more thermoplastic synthetic resins each having a number-average molecular weight in a range of 20000-150000 at a draft ratio of 200-2300. In the case of the mixture consisting of at least two types of thermoplastic synthetic resin Ra, Rb having number-average molecular weights Ma, Mb, respectively, wherein a ratio Ma/Mb is 1.1 or higher, Ra is of 20-80 wt %, Rb is of 80-20 wt % and a sum of Ra and Rb makes up 50-100 wt % of the mixture.

4 Claims, 2 Drawing Sheets

PROCESS FOR MAKING FIBROUS WEB HAVING INELASTIC EXTENSIBILITY

BACKGROUND OF THE INVENTION

This invention relates to a process for making a fibrous web having inelastic extensibility.

Japanese Patent Application No. 2001-18315A discloses a process for making a composite sheet having inelastic extensibility. This process generally comprises the steps of placing a first web made of thermoplastic synthetic fibers and inelastically extensible in one direction upon at least one surface of a second web made of a thermoplastic synthetic resin and elastically extensible in the one direction and bonding the. first web to the second web intermittently in the one direction. These first and second webs bonded to each other in this manner are stretched together in the one direction without exceeding the elastic limit of the second web as well as the breaking extension of the first web. Then the second web is left to contract under its elasticity and thereupon the composite sheet having a predetermined elastic extensibility is obtained. The composite sheet obtained in this manner is appropriately bulky and has a soft touch because the composite sheet contracts after the component fibers of the first web have been stretched and permanently set. In this way, this composite sheet can be used as a suitable stock material for the disposable wearing article such as a disposable diaper or a disposable gown.

In order to ensure that the step of stretching the first web gives the above-cited composite sheet of prior art the appropriate bulkiness desired for a stock material used in the wearing article, the first web is stretched preferably by 50-400%, more preferably by 70-200% and then contracted preferably 100-70% under a contractile force of the second web. To ensure the soft touch essential to a stock material for the wearing article, fibers having a small diameter, for example, of 20 μm or less is preferably used as the component fibers of the first web and such fibers are stretched preferably by 70-200%. However, depending on the component fibers of the first web, stretching of the component fibers of the first web at this ratio may cause fiber breakage in many of the component fibers and the resultant composite sheet may exhibit fuzz due to the fiber breakage. Such fuzz may often deteriorate luster and soft touch desired for this composite sheet. This inconvenience is due to the fact that, in the course of melt spinning these fibers, high draft exerted on the fibers promotes orientation of the polymer molecules constituting the fibers and such orientation restricts the extensibility of the fibers. Even if the fibers have a relatively high extensibility, the orientation will result in a high stretch stress of the fibers and a correspondingly large force will be necessary to stretch the first web. In other words, such first web can not be easily stretched.

SUMMARY OF THE INVENTION

In view of the problem as has been described above, it is an object of this invention to provide a fibrous web, particularly the fibrous web having a high inelastic extensibility obtained by improving the conventional process for making the component sheet.

According to this invention, there is provided a process for making a fibrous web having inelastic extensibility comprising the steps of melt spinning continuous fibers of thermoplastic synthetic resin having inelastic extensibility from a plurality of nozzles and accumulating these continuous fibers on continuously running belt.

The thermoplastic synthetic resin is provided in the form of a mixture of at least two different types of thermoplastic synthetic resins each having number-average molecular weight of 20000-150000, the mixture including a thermoplastic synthetic resin Ra of 20-90 wt % and having number-average molecular weight Ma and a thermoplastic synthetic resin Rb of 80-10 and having number-average molecular weight Mb, the mixture being prepared so that a sum of the thermoplastic synthetic resin Ra and the thermoplastic synthetic resin Rb makes up 50-100 wt % of the mixture and a number-average molecular weight ratio Ma/Mb of the thermoplastic synthetic resin Ra and the thermoplastic synthetic resin Rb is 1.1 or higher; and the mixture is melt spun at a draft ratio of 200-2300 to obtain the continuous fibers each having a fiber diameter of 5-20 μm and thereby to obtain the fibrous web comprising such continuous fibers.

This invention includes preferred embodiments as follow:

The process for making the fibrous web comprises a step of placing an elastically extensible web upon and bonding this to at least one surface of the fibrous web. The elastic web is made of thermoplastic synthetic fibers. The elastic web is provided in the form of a film.

DETAILED DESCRIPTION OF THE PREFERRED EMBODIMENTS

Details of a process for making a fibrous web having inelastic extensibility according to this invention will be more fully understood from the description given hereunder in reference with the accompanying drawings.

Figure 1:
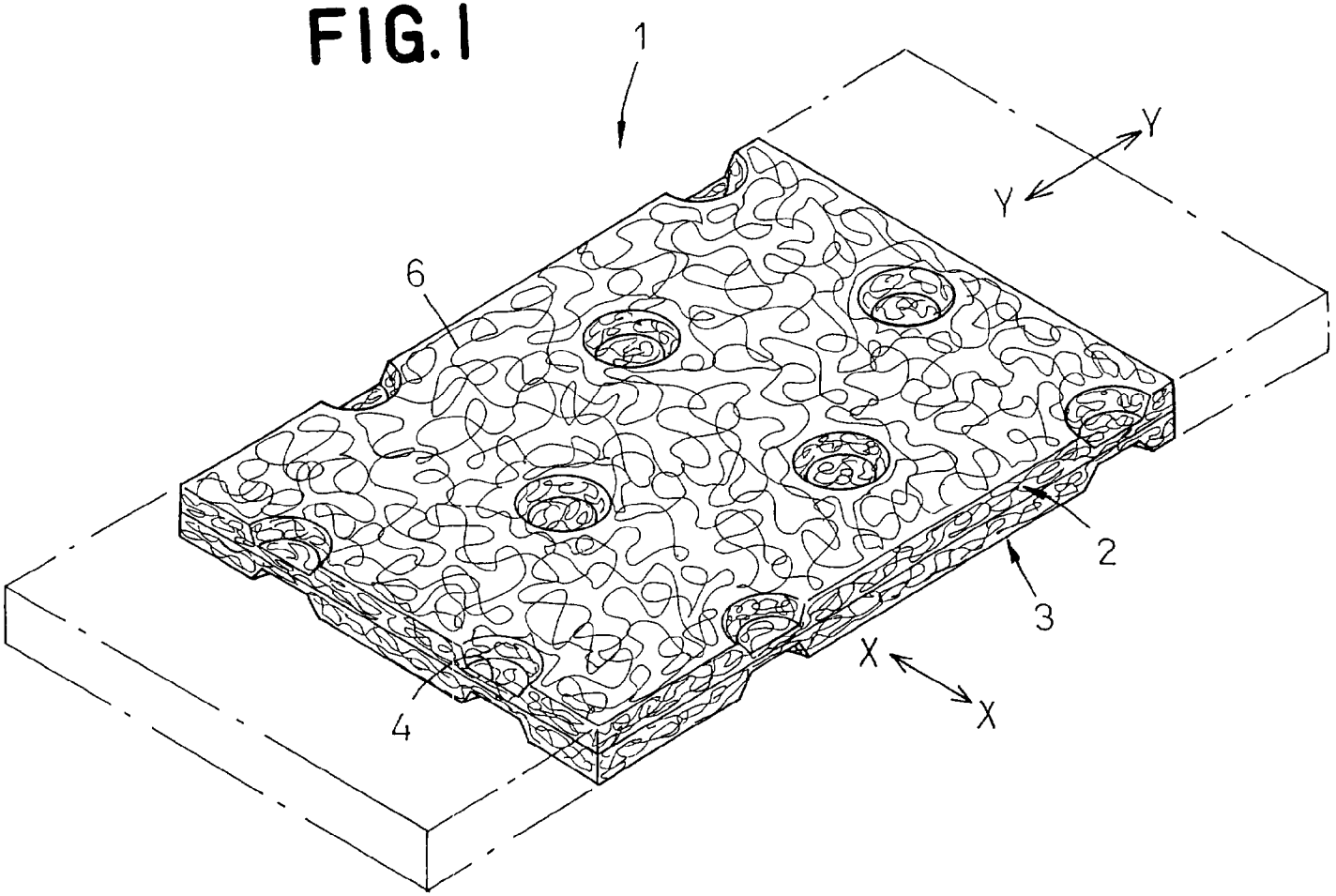
FIG. 1 is a perspective view of a composite sheet according to this invention.

A composite sheet 1 having elastic extensibility shown by FIG. 1 in a perspective view comprises an upper layer 2 and a lower layer 3 which are welded together at bonding regions 4. The composite sheet is defined by a pair of directions orthogonal to each other as indicated by double-headed arrows X-X and Y-Y and elastically extensible at least the direction Y-Y.

The upper layer 2 of the composite sheet 1 is inelastically extensible at least in the direction Y-Y. This upper layer 2 is obtained by stretching an assembly of inelastically stretchable continuous fibers 6 made of a thermoplastic synthetic resin in the direction Y-Y or in the direction X-X and in the direction Y-Y. Preferably, the fibers 6 are welded together in the respective bonding regions 4 but not welded together in the remaining region defined between each pair of the adjacent bonding regions 4. In the remaining region, the continuous fibers 6 extend on an upper surface of the lower layer 3 so as to describe irregular curves. At least two types of thermoplastic synthetic resins having different number-average molecular weights in a range of 20000-150000 are mixed with each other and this mixture is melt spun to obtain the continuous fibers 6.

The lower layer 3 of the composite sheet 1 is a sheet having elastic extensibility in the direction Y-Y, preferably not only in the direction Y-Y but also in the direction X-X. The lower layer 3 is extensible in the direction Y-Y at least by 200%, preferably at least by 400% and, after having been stretched by 100%, elastically contractible to less than 1.3 times of its initial length. The sheet may be selected from a group including carded web made of an elastic yarn, nonwoven fabric such as a thermal bond nonwoven fabric made of elastic yarn or a spun lace nonwoven fabric, a woven fabric made of elastic yarn and a film made of thermoplastic elastomer.

These upper and lower layers 2, 3 may be bonded together in the bonding regions 4 by heating them under a pressure or by supersonic treatment. If the continuous fibers 6 of the upper layer 2 can be mechanically entangled with texture of the lower layer 3 to integrate them, a needle punching or high pressure columnar water jet treatment may be adopted as a means for entangling. It is also possible to bond these two layers 2, 3 to each other using suitable adhesives such as hot melt adhesives. The bonding regions 4 are formed intermittently at least in the direction Y-Y and each of these regions 4 has an area in the order of 0.03-10 $mm^2$. Total area of the regions 4 preferably occupies 1-50% of the area of the composite sheet 1.

The lower layer 3 is elastically stretched in the direction Y-Y as the composite sheet 1 is pulled, for example, in the direction Y-Y and stretching of the lower layer 3 causes the continuous fibers 6 describing curves to be reoriented so as to extend in the direction Y-Y. A force required to pull the composite sheet 1 substantially corresponds to a force required to pull the lower layer 3 and the upper layer 2 merely reorients the continuous fibers 6, so the force required to pull the composite sheet 1 is substantially not affected by the upper layer 2. The continuous fibers 6 describing the curves are straightened between each pair of the adjacent bonding regions 4 in which the continuous fibers 6 are bonded to the lower layer 3 as the composite sheet 1 is further pulled with the lower layer 3 being further elastically deformed. To pull the composite sheet 1 from such a state, in addition to the force required to pull the lower layer 3, a force for inelastically stretching the continuous fibers 6 which are now in a straightened state is required.

Figure 2:
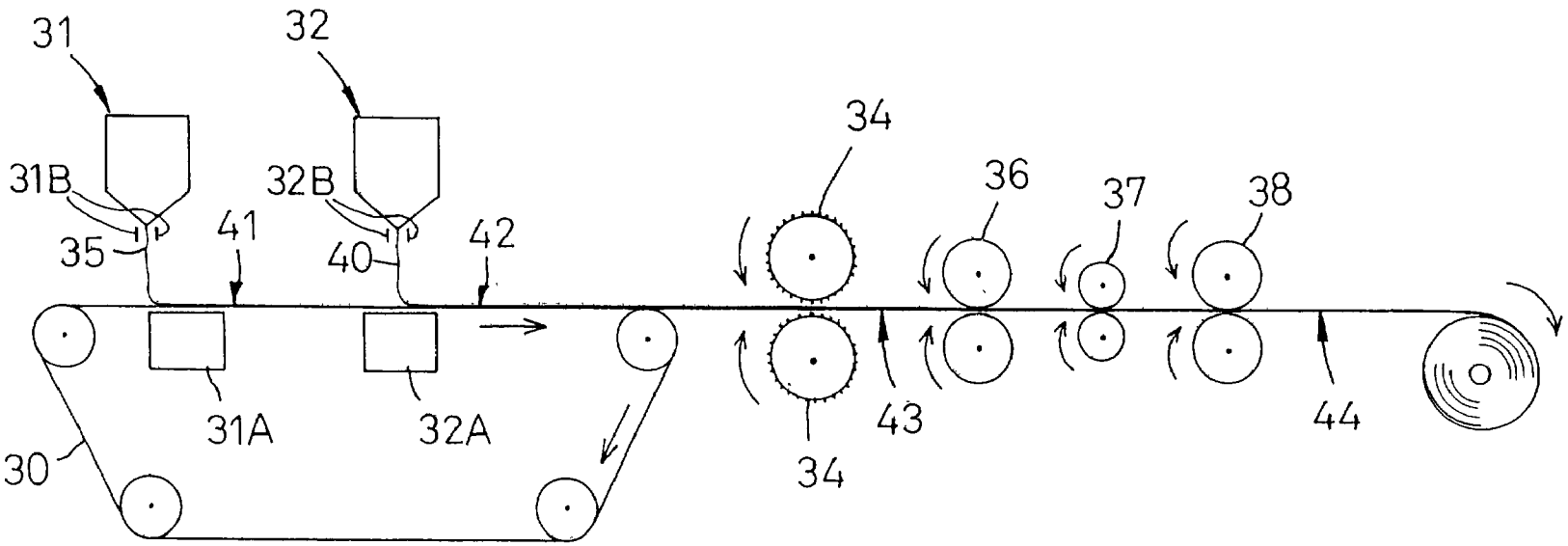
FIG. 2 is a diagram illustrating a process for making the composite sheet.

FIG. 2 is a diagram illustrating an example of the process for making the composite sheet 1. An endless belt 30 continuously runs from the left toward the right as viewed in FIG. 2. At the left hand in FIG. 2, a first extruder 31 is provided above the belt 30 immediately below which there is provided a quenching air blower 31B, and a suction mechanism 31A underlies the belt 30. The first extruder 31 has a plurality of nozzles arranged transversely of the belt 30 and a thermoplastic synthetic resin having inelastic extensibility is melt spun from these nozzles to form first continuous fibers 35. These first continuous fibers 35 are quenched, thereby drafted at a predetermined ratio under a suction effect before these first continuous fibers 35 reach the belt 30 and accumulated on the belt 30 so as to describe irregular curves. In this way, first web 41 is formed. For the preferred first web 41, the continuous fibers 35 placed one upon another may be welded together or not at intersections of the fibers 35.

The first continuous fibers 35 are obtained by melt spinning a mixture of at least two types of thermoplastic synthetic resins Ra, Rb having different number-average molecular weights in a range of 20000-150000 from the first extruder 31. The resin Ra has a number-average molecular weight Ma and occupies 20-90 wt % of the first continuous fibers 35 while the resin Rb has a number-average molecular weight Mb and occupies 80-10 wt % of the first continuous fibers 35. A sum of these two types of resins Ra, Rb occupies 50-100 wt % of the first continuous fibers 35. Between these two types of resins Ra, Rb, a mutual number-average molecular weight ratio Ma/Mb is 1.1 or higher. The resin mixture including at least these two types of resins Ra, Rb is discharged from the nozzles each having a diameter of 500 μm, drafted at a ratio of 200-2300, more preferably at a ratio of 200-1000 and then reaches the belt 30 to form the first continuous fibers 35 each having a diameter of 5-20 μm. The resin Ra and the resin Rb may be selected from various types of resins suitable for melt spinning such as homopolymer of propylene, copolymer, for example, of propylene and ethylene, polyester, polyethylene and nylon.

The first continuous fibers 35 obtained in this manner exhibit an index of double refraction (Δn) smaller than $25\times10^{-3}$ and can be easily stretched by 250% or higher. The first web 41 comprising these first continuous fibers 35 can be also stretched by 250% or higher substantially without causing fiber breakage in the machine direction and/or in the direction crossing the machine direction.

On the right of the first extruder 31, there are provided a second extruder 32, a quenching air blower 32B and a suction mechanism 32A. The second extruder 32 also has a plurality of nozzles arranged transversely of the belt 30 and a thermoplastic synthetic resin having elastic extensibility is melt spun from these nozzles to form second continuous fibers 40. These second continuous fibers 40 are drafted at a desired ratio before these second continuous fibers 40 reach the belt 30 and accumulated on the belt 30 so as to describe irregular curves. In this way, a second web 42 is formed. The continuous fibers 40 placed one upon another are welded together and a discharging condition of the second extruder 32 is selected so that the second web 42 may form a sheet having elastic extensibility in the machine direction along which the belt 30 runs, more preferably in the machine direction as well as in the direction crossing the machine direction.

The first and second webs 41, 42 placed upon each other are heated under a pressure intermittently in the machine direction as well as in the direction crossing the machine direction or at least in the machine direction as these webs 41, 42 pass a nip defined between a pair of embossing rolls 34, 34 arranged in a vertical direction and thereby welded together to form a first composite web 43.

The first composite web 43 then passes first, second and third stretching roll pairs 36, 37, 38. Rotational speeds of the first and third roll pairs 36, 38 are same but lower than a rotational speed of the second roll pair 37. A difference of the rotational speeds between the first and second roll pairs 36, 37 is adjusted so that the first composite web 43 can be stretched to a predetermined ratio at a temperature of 10-60μ, more preferably at a room temperature of 15-40μ. Between the second and third roll pairs 37, 38, the first composite web 43 having been stretched in this manner is elastically contracted to its initial length to form a second composite web 44.

In the step of stretching the first composite web 43, the first continuous fibers 35 are stretched, lengthened and diameter-reduced due to plastic deformation, i.e., permanent setting between each pair of adjacent regions in which these fibers 35 are welded together by the embossing roll pair 34. The second web 42 comprising the second continuous fibers 40 are elastically extended within an elastic limit of these second continuous fibers 40 between each pair of the adjacent welded regions. The first composite web 43 preferably has an extensibility of 50-400%, more preferably has an extensibility of 70-200%.

In the first composite web 43 being stretched in this manner, the first continuous fibers 35 as well as the first web 41 are extensible by 250% or higher and the second web 42 has an extensibility higher than that of the first web 41. With a consequence, no fuzz occurs due to breakage of the first and second continuous fibers 35, 40 in the second composite web 44 obtained from the first composite web 43.

After rolled up, the second composite web 44 is cut in appropriate dimension to obtain the composite sheets 1. The first web 41 and the second web 42 in the second composite web 44 are destined to form the upper layer 2 and the lower layer 3 of the composite sheet 1 shown by FIG. 1. The regions of the second composite web 44 in which the fibers have been welded together by the embossing roll pair 34 are destined to form the bonding regions 4 of the composite sheet 1.

When the second composite web 44, i.e., the composite sheet 1 is used as a stock material for the disposable wearing article such as a disposable diaper, a sanitary napkin or a disposable gown, it is not likely that a frictional stickiness peculiar to a rubber-based material might irritate the wearer's skin so far as the first web 41 is used so as to come in contact with the wearer's skin even if the second web 42 contains the rubber-based material. In the second composite sheet 44, the first continuous fibers 35 are extended and diameter-reduced, so that the second composite sheet 44 becomes further flexible. In the first web 41, the first continuous fibers 35 are permanently set and lengthen, so that the first web 41 becomes bulky and offers a comfortable touch. With the arrangement such that the first continuous fibers 35 of the second composite web 44 are welded neither one to another nor to the second web 42 except in the bonding regions 4 formed by embossing, the second composite web 44 can be sufficiently stretched merely by a relatively weak initial force required to stretch only the second web 42. The second composite web 44 is easily stretchable and flexible in spite of comprising the upper and lower layers. In the process illustrated as an example, the first and second webs 41, 42 in the second composite web 44 respective have basis weights which are the same as those when discharged from the respective extruders 31, 32. The first and second webs 41, 42 are fibrous assemblies and the second composite web 44 obtained from these fibrous assemblies are generally breathable.

The steps of the process according to this invention are not limited to the steps illustrated as one example but may be variously modified. For example, it is possible to obtain the first and second webs 41, 42 separately, i.e., without placing them upon each other and to use them as the fibrous webs having inelastic extensibility. It is also possible to feed the second web 42 onto the belt 30 prior to the first web 41 and then to place the first web 41 upon the second web 42. To bond the first and second webs 41, 42 to each other, instead of treatment by the embossing roll pair 34, the other technique such as a needle punching or high pressure columnar water jet treatment may be adopted or any one of the webs 41, 42 may be coated with hot melt adhesives in an appropriate pattern such as a spiral pattern. Furthermore, it is also possible to provide a third extruder on the downstream of the second extruder 32 so that third continuous fibers having inelastic extensibility discharged from this extruder may form upon the second web 42 a third web similar to the first web 41 and thereby to obtain a three-layered composite sheet 1 comprising the first, second webs 41, 42 and the third web. The first web 41 and this third web may be of the same basis weight or different basis weights.

Factors of the resin such as types, fineness and appearance inclusive of color may be different. It is also possible to use a film made of a thermoplastic elastomer as the second web 42.

EXAMPLE

In the process illustrated as one example, two types of homopolymer of propylene and two types of copolymer of propylene and ethylene were used as two types of thermoplastic synthetic resin Ra, Rb and the first continuous fibers and the first web in the form of the assembly of these fibers having a basis weight of 15 g/m$^2$ was obtained. As the second web, the assembly of the continuous fibers of styrene-based elastomer having a basis weight of 20 g/m$^2$ and a breaking extension of 400% or higher was obtained. These first and second webs were placed upon each other and bonded intermittently in the machine direction (rightward as viewed in FIG. 2) to obtain the first composite web. The first composite web was extended by 100% in the machine direction and then contracted to obtain the second composite web, i.e., the composite sheet having elastic extensibility.

Number-average molecular weights Ma, Mb and mixing ratio of the two types of thermoplastic synthetic resin Ra, Rb used to obtain the first continuous fibers, melt spinning temperature and draft ratio for the resin mixture, and fiber diameter, breaking extension and double refraction of the first continuous fibers are indicated in Table 1.

(Control)

From respective controls in which, instead of the first continuous fibers in the Examples, fibers of a single type of propylene homopolymer were used, in which a number-average molecular weight ratio of two types of thermoplastic synthetic resin was smaller than that in Examples, in which a mixing ratio of two types of thermoplastic synthetic resin was higher or lower than that in Examples and in which a draft ratio was higher or lower than that in Examples, it was found that the fibers each having a fiber diameter of 20 μm has breaking extensions and double refractions as indicated in Table 1.

As will be apparent from these Examples, the inelastically extensible fibers obtained by the process according to this invention a double refraction as low as $25\times10^{-3}$ or less and a breaking extension as high as 250% or higher. obviously, the fibrous web obtained from such fiber has a correspondingly high breaking extension.

TABLE 1

| | Thermoplastic synthetic resin | | | | | | Manufacturing conditions | | | | |
|---|---|---|---|---|---|---|---|---|---|---|---|
| | Resin: Ra | | Resin: Rb | | | | | | | Properties of fiber | |
| | Type (anno-tation) | Number-average molecular waight of Ma | Type | Number-average molecular weight of Mb | Molecular weight ratio Ma/Mb | Mixture ratio of resin Ra (wt %) | Resin temper-ature (° C.) | Draft ratio | Fiber diameter (μm) | Breaking extension (%) | Double refraction $\times10^{-3}$ |
| Example 1 | homo-PP | 111000 | home-PP | 91000 | 1.22 | 40 | 240 | 850 | 14.2 | 402 | 20.8 |
| Example 2 | " | " | " | " | " | " | 240 | 210 | 18.1 | 472 | 17.4 |
| Example 3 | homo-PP | 111000 | homo-PP | 91000 | 1.22 | 20 | 240 | 350 | 14 2 | 256 | 24.3 |
| Example 4 | " | " | " | " | " | " | 240 | 450 | 19.4 | 286 | 21.4 |
| Example 5 | homo-PP | 111000 | homo-PP | 91000 | 1.22 | 90 | 240 | 810 | 14.5 | 320 | 24.0 |
| Example 6 | " | " | " | " | " | " | 240 | 200 | 19.6 | 378 | 22.8 |
| Example 7 | co-PP | 99000 | co-PP | 81000 | 1.22 | 40 | 240 | 390 | 13 8 | 424 | 20.3 |
| Example 8 | " | " | " | " | " | " | 240 | 250 | 17 3 | 475 | 17.2 |
| Example 9 | co-PP | 99000 | co-PP | 81000 | 1.22 | 20 | 240 | 1000 | 13.2 | 273 | 22.2 |
| Example 10 | " | " | " | " | " | " | 240 | 450 | 19.9 | 302 | 20.9 |
| Control 1 | homo-PP | 111000 | — | — | — | 100 | 240 | 780 | 14.9 | 176 | 28.0 |

TABLE 1-continued

| | Thermoplastic synthetic resin | | | | | | Manufacturing conditions | | | | |
|---|---|---|---|---|---|---|---|---|---|---|---|
| | Resin: Ra | | Resin: Rb | | | | | | | Properties of fiber | |
| | Type (anno-tation) | Number-average molecular waight of Ma | Type | Number-average molecular weight of Mb | Molecular weight ratio Ma/Mb | Mixture ratio of resin Ra (wt %) | Resin temper-ature (° C.) | Draft ratio | Fiber diameter (μm) | Breaking extension (%) | Double refraction $\times 10^{-3}$ |
| Control 2 | " | " | — | — | — | " | 240 | 490 | 18.7 | 230 | 26 0 |
| Control 3 | homo-PP | 111000 | homo-PP | 106000 | 1.05 | 40 | 240 | 320 | 15.2 | 184 | 27.3 |
| Control 4 | " | " | " | " | " | " | 240 | 470 | 19.3 | 238 | 25.7 |
| Control 5 | homo-PP | 111000 | homo-PP | 91000 | 1.22 | 95 | 240 | 760 | 14.9 | 233 | 26.3 |
| Control 6 | " | " | " | " | " | " | 240 | 450 | 19.8 | 243 | 25.5 |
| Control 7 | homo-PP | 111000 | homo-PP | 91000 | 1.22 | 15 | 240 | 900 | 14 0 | 232 | 26.4 |
| Control 8 | " | " | " | " | " | " | 240 | 210 | 18.2 | 248 | 25.5 |

(Annotation)
homo-PP: Homopolymer of propylene
co-PP: Copolymer of propylene/ethylene The process according to this invention enables the fibrous web having inelastic extensibility and high breaking extension to be easily obtained. The fibrous web may be placed on and bonded to the elastically extensible web to obtain the composite web substantially free from fuzz due to fiber breakage.

What is claimed is:

1. A process for making a fibrous web having inelastic extensibility generally comprising the steps of:

providing a thermoplastic synthetic resin;

melt spinning continuous inelastically extensible fibers from the thermoplastic synthetic resin through a plurality of nozzles; and accumulating the inelastically extensible continuous fibers on continuously running belt, said thermoplastic synthetic resin comprising a mixture of at least two different types of thermoplastic synthetic resins each having number-average molecular weight of 20000-150000, said mixture including:

a first thermoplastic synthetic resin which comprises 20-90 wt. % of the inelastically extensible fibers and has a number-avenge molecular weight $M_1$; and a second thermoplastic synthetic resin which comprises 80-10 wt. % of the inelastically extensible fibers and has a number-average molecular weight $M_2$, said mixture being prepared so that a sum of said first thermoplastic synthetic resin and said second thermoplastic synthetic resin makes up 50-100 wt % of said mixture and a number-average molecular weight ratio of said first thermoplastic synthetic resin to said second thermoplastic synthetic resin is 1.1 or higher, said melt spinning comprising using a draft ratio of 200-2300 so that said continuous inelastically extensible fibers each have a fiber diameter of 5-20 μm.

2. The process according to claim 1, further comprising the steps of:

providing an elastically extensible web;

placing the elastically extensible web upon at least one surface of the fibrous web; and bonding the elastically extensible web to e said fibrous web.

3. The process according to claim 2, wherein said elastically extensible web is made of thermoplastic synthetic fibers.

4. The process according to claim 2, wherein said elastically extensible web comprises a film.

* * * * *